United States Patent [19]

Prather et al.

[11] 4,061,371

[45] Dec. 6, 1977

[54] SELF-LOCKING DEVICES

[75] Inventors: Joseph E. Prather, Bernardsville; Ramzi A. Khalifa, Rutherford, both of N.J.

[73] Assignee: Edson Tool & Manufacturing Company, Inc., Belleville, N.J.

[21] Appl. No.: 658,265

[22] Filed: Feb. 17, 1976

[51] Int. Cl.[2] ..... E05C 3/04

[52] U.S. Cl. ..... 292/198; 174/38; 220/3.8; 220/324; 292/203; 292/304; 312/222

[58] Field of Search ..... 292/198, 203, 216, 300, 292/304, DIG. 4, 301, 302, DIG. 11, 218; 220/3.8, 324; 138/158, 167; 174/38, 66; 312/220, 222

[56] References Cited

U.S. PATENT DOCUMENTS

| | | | |
|---|---|---|---|
| 2,548,046 | 4/1951 | Nottingham | 292/198 X |
| 2,750,219 | 6/1956 | Bleam | 292/198 |
| 2,930,459 | 3/1960 | Moser | 292/218 X |
| 3,087,749 | 4/1963 | Capton | 292/216 X |
| 3,123,389 | 3/1964 | Biesecker | 292/218 |
| 3,563,577 | 2/1971 | Wittenmayer | 292/216 X |
| 3,868,474 | 2/1975 | Bunten | 174/38 |

FOREIGN PATENT DOCUMENTS

| | | | |
|---|---|---|---|
| 363,399 | 12/1931 | United Kingdom | 292/203 |

*Primary Examiner*—Roy D. Frazier
*Assistant Examiner*—William E. Lyddane
*Attorney, Agent, or Firm*—Alexander T. Kardos

[57] ABSTRACT

A self-locking device for locking a movable member to a stationary member including a rotatable latch member mounted on the stationary member and having a pair of ears located on opposite sides of its axis of rotation, the movable member having a pair of heels cooperations with the ears of the latch member in such a way that longitudinal movement of the movable member relative to the stationary member and toward the closed position causes one of the heels to engage one of the ears on the latch member thereby rotating the latch member until the other ear engages the other heel to latch the movable member in the closed position, the face on the other ear and the face on the other heel being angularly positioned with respect to the axis of rotation of the latch member such that movement of the other heel toward the open position will not impart any substantial rotary movement to the latch member to cause it to rotate to an unlatched position, thereby preventing movement of the movable member in the opening direction.

15 Claims, 8 Drawing Figures

FIG. 3
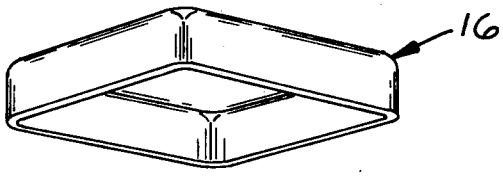
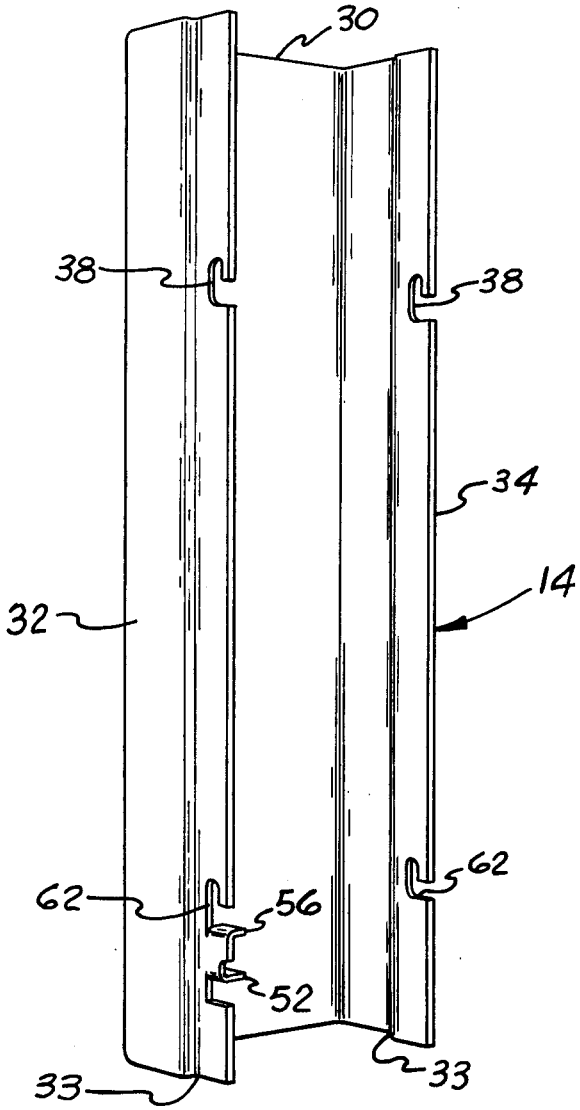
FIG. 2
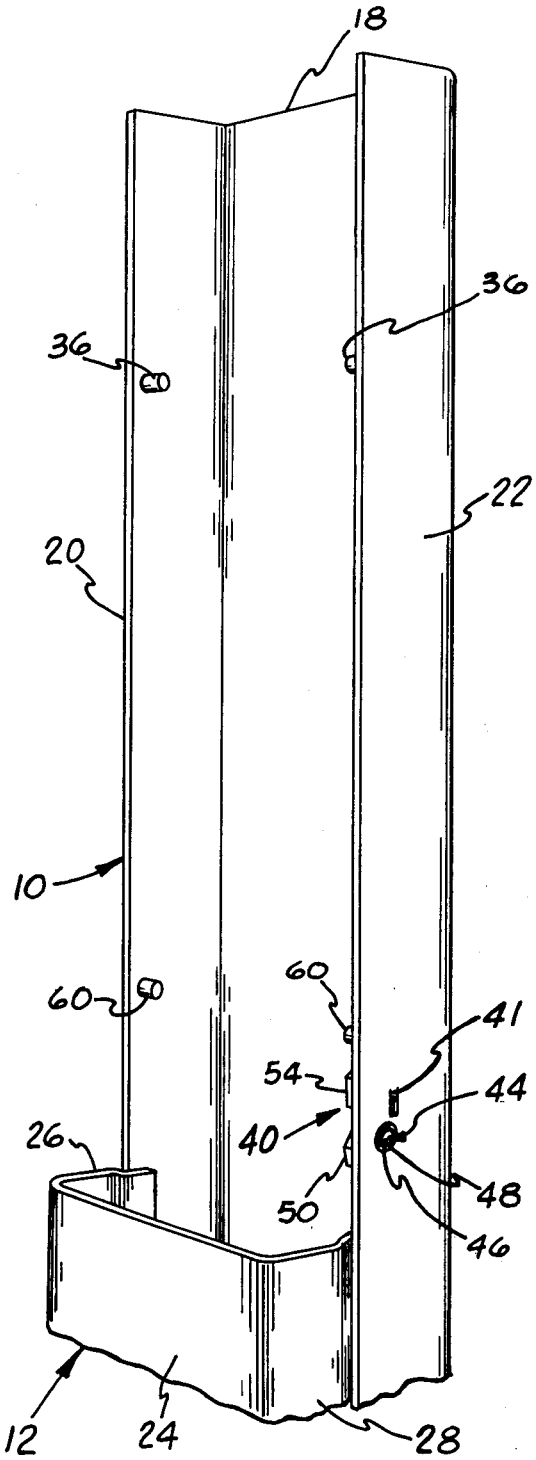
FIG. 1

FIG. 6
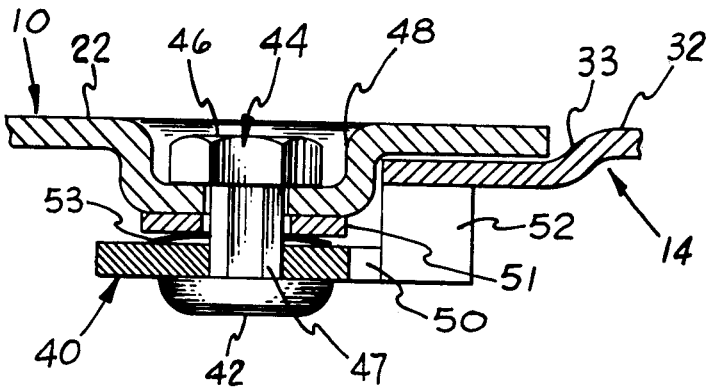
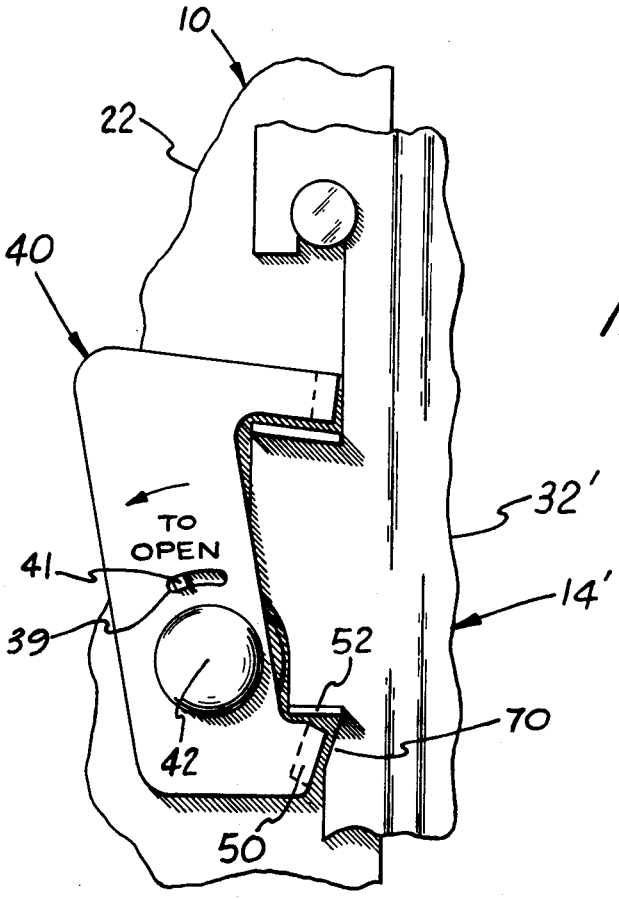
FIG. 7
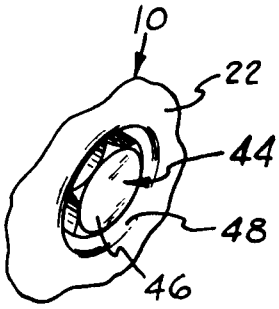
FIG. 8

SELF-LOCKING DEVICES

FIELD OF THE INVENTION

The present invention relates to self-locking devices and more particularly is concerned with self-locking devices which are capable of very simply and very easily locking a movable member to a stationary member, or to another movable member, and subsequently very simply and very easily unlocking such members. Even more particularly, the present invention relates to self-locking devices for locking and unlocking access members, such as covers, panels, doors, and the like, which provide access or entry to various enclosures of all kinds.

BACKGROUND OF THE INVENTION

Self-locking devices for locking various members together and subsequently unlocking them have been known and used for many years and there are many commercially successful self-locking devices which are currently available on the open market. However, there is always a need and a desire to make these self-locking devices simpler and easier to operate, as well as more economical to manufacture and to maintain in service and use. Also, there is always a need and a desire to make these self-locking devices more automatic and self-actuating in their operation and more foolproof and tamper-proof in their service and use.

PURPOSES AND OBJECTS OF THE INVENTION

It is therefore a principal purpose and object of the present invention to provide an improved self-locking device which is very simple and very easy to operate, very economical to manufacture and to maintain in service and use, automatic and self-actuating in its operation, and substantially fool-proof and tamper-proof in its use.

BRIEF SUMMARY OF THE INVENTION

It has been found that such principal purposes and objects of the present invention, as well as other principal purposes and objects which will become clear from a further reading and understanding of this specification, may be achieved by providing a self-locking device for locking a movable member to a stationary member, or to another movable member, or for unlocking the same, comprising a rotatable self-locking latching member and an actuating means therefor, the self-locking latching member being rotatably mounted on a first member and having a first ear thereon, capable of preventing movement of an other member in a first direction and a second ear thereon, capable of preventing movement of the other member in the opposite direction, and the actuating means being capable of rotating the self-locking latching member whereby the first ear contacts a heel or the other member and forcibly moves it in the so-called opposite direction, while the second ear is being simultaneously moved out of the way of the other member, due to rotation of the self-locking latching member to permit such movement in such opposite direction to unlock the other member from the first member, and then, the heel of the other member being subsequently capable of being moved in the so-called first direction to contact the first ear to forcibly rotate the self-locking latching member in a direction opposite to that of its first rotation, whereby the other member returns to its original locked position wherein it is prevented from further movement in the so-called first direction by the first ear and with the second ear being simultaneously moved into the way of the other member, due to the rotation of the self-locking latching member, to prevent movement of the other member in the so-called opposite direction.

Although the present inventive concept will be described and illustrated in greater particularity with reference to aboveground connection and splice enclosures or other terminal enclosures for buried communication or power cable installations, or the like, it is to be appreciated that the principles of the present inventive concept are equally applicable to other enclosures of all types and kinds, including, for example, chambers, compartments, chests, rooms, or other receptacles or containers, which it is desired or required to close and lock. As used herein, therefore, the terms "enclosure member" or "access member" are intended to include such elements as covers, panels, doors, walls, barriers, frames, and the like, which may be slidable, or rotatable, or hinged, or otherwise constructed, which are used to form the elements of enclosures or are used to provide entry or access to such enclosures.

BRIEF DESCRIPTION OF THE DRAWINGS

In the following specification and accompanying self-explanatory drawings, there are described and illustrated preferred embodiments of the present inventive concept, but it is to be realized that the invention, in its broader aspects, is not to be considered as limited to such preferred embodiments as disclosed, except as determined by the scope and spirit of the appended claims.

Referring to the accompanying self-explanatory drawings,

FIG. 1 is a fragmentary perspective view of a part of the back cover and lower front cover of an aboveground terminal enclosure for buried communication cable or power cable installations, employing the principles of the present invention, with the upper front cover and cap removed;

FIG. 2 is a perspective view, showing the upper front cover of the terminal enclosure of FIG. 1, as removed from the back cover thereof;

FIG. 3 is a perspective view, showing the cap for the terminal enclosure of FIG. 1, as removed from the top thereof;

FIG. 6 is a fragmentary, cross-sectional view, taken on the line 6—6 of FIG. 4, showing the construction of the actuating means to rotate the latching mechanism of the improved self-locking device of the present invention;

FIG. 7 is a fragmentary, schematic and diagrammatic elevational view, showing a modification of the preferred embodiment of the present invention, as illustrated in FIGS. 1–6, also in the closed or locked position, and as viewed from the interior of the terminal enclosure; and FIG. 8 is a fragmentary perspective view, showing in larger scale the actuating bolt and the embossed recess surrounding the same.

DESCRIPTION OF THE PEFERRED EMBODIMENT

Figure 4:
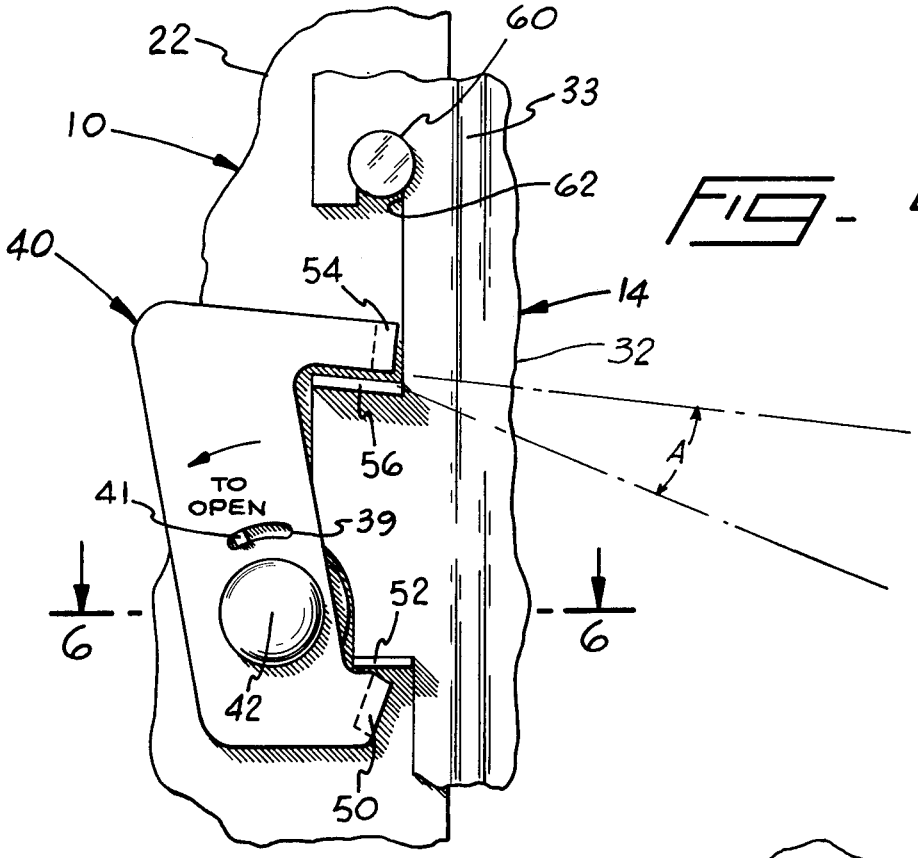
FIG. 4 is a fragmentary, schematic and diagrammatic elevational view of a preferred embodiment of the improved self-locking device and latching mechanism of the present invention in its closed or locked position, as viewed from the interior of the terminal enclosure.

With reference to FIGS. 1-3 of the drawings, there is shown an above-ground terminal enclosure comprising a back cover 10; a lower front cover 12; an upper front cover 14 which is removable from the back cover 10; and a cap 16 which is adapted to fit over and protect the upper ends of the back cover 10 and the upper front cover 14 and to keep rain, snow, sleet, etc., from the interior of the terminal enclosure, when it is assembled and in use.

The back cover 10 is a substantially U-shaped channel member and comprises a rear wall 18 and a pair of side flanges 20, 22 which are approximately at right angles to the rear wall 18.

The lower front cover 12 is also a substantially U-shaped channel member and comprises a lower front wall 24 and pair of side flanges 26, 28 which are approximately at right angles to the lower front wall 24.

The back cover 10 and the lower front cover 12 are adapted to fit together and to be bolted together, or otherwise secured to each other, as shown, to form an elongated, lower enclosure compartment in which communication or power cables, terminals, and related equipment are contained.

The lower front cover 12 may be separated from the back cover 10, if desired or required but, once the communication or power cables, terminals and other equipment and parts have been installed and the lower front cover 12 and the back cover 10 are secured together and partially buried in the ground to a depth, as shown in FIG. 1, the lower front cover 12 is normally not removed for service, maintenance, or other purposes.

The upper front cover 14 is similarly a substantially U-shaped channel member and comprises an upper front wall 30 and a pair of side flanges 32, 34 which are substantially at right angles to the upper front wall 30. The upper front cover 14 has approximately the same horizontal-plane cross-section as the lower front cover 12 and, when assembled together in use, generally forms an extension of the lower front cover 12. The upper front cover 14 is adapted to fit together with the upper portion of the back cover 10 to define an elongated upper enclosure compartment in which communication or power cables, terminals, and related equipment is contained.

The upper front cover 14 and the back cover 10 are not permanently secured together, as by bolting, or the like, but are adapted to be held together by means including a pair of laterally projecting lanced tabs, pins, or shoulder rivets 36, 36 and a pair of guiding and locking slots 38, 38 and to be locked in such a configuration, or opened, by means to be described more fully hereinafter. Such opening of the interior of the terminal enclosure is, of course, accomplished by unlocking and removing the upper front cover 14 from the back cover 10.

The side flanges 32, 34 of the upper front cover 14 are each provided with inwardly directed off-set portions 33, 33 which permit them to nest and fit within the side flanges 20, 22 of the back cover 10. Such an overlapping, nesting arrangement adds to the tamper-proof and weather-proof features of the terminal enclosure.

The cap 16 has a horizontal-plane cross-section which is approximately rectangular or square and is adapted to fit over the upper ends of the back cover 10 and the upper front cover 14, when they are assembled and in use, to cover and protect them and the terminal enclosure from the elements. The cap 16 may be a separate part but, preferably, it is permanently secured in position to the top of either the back cover 10 or the upper front cover 14 to prevent it from being lost or misplaced and to facilitate and to expedite the assembly of the upper front cover 14 to the back cover 10.

It is to be realized that, if the laterally projecting lanced tabs, pins, or shoulder rivets 36, 36 and the guiding and locking slots 38, 38 were the sole means of holding and locking the upper front cover 14 in position with respect to the back cover 10 during use, anyone, whether authorized or unauthorized, but with sufficient curiosity or with vandalism in mind, could easily gain access to the interior of the terminal enclosure by simply lifting up and removing the upper front cover 14. Such is, of course, highly undesirable. Therefore, an automatically-operable, self-locking means is additionally provided to easily and simply secure and lock the upper front cover 14 in position with respect to the back cover 10 during use and to easily and simply unlock these members to open the terminal enclosure for maintenance, service, or for other purposes. Such is highly desirable to insure the safety and the security and protection of the equipment and parts in the terminal enclosure and to enhance its tamper-proof and vandal-proof features.

THE SELF-LOCKING LATCHING MECHANISM

As noted primarily if FIG. 4, a self-locking latching mechanism is provided for the terminal enclosure and comprises, as its main element, a rotatable latching means or member 40 which is rotatable about a center 42. As best shown in FIG. 6, a bolt 44 having a hexagonal head 46 fits within an embossed cylindrical recess 48 formed in the side flange 22 of the back cover 10. The shank 47 of the bolt is hexagonal and passes through a circular opening in the side flange 22 and then through a closely fitting, matching hexagonal opening in the rotatable latching member 40 and is then clinched or peened back or flattened against the rear surface of the rotatable latching member 40 so that the rotatable latching member 40 will not slip off the end of the bolt 44 but will rotate together with the bolt 44, whenever the bolt is rotated. Other means to secure the bolt 44 in positive, non-slipping engagement with the rotatable latching member 40 can, of course, be used. The cross-sectional area of the shank 47 of the bolt 44 and the corresponding matching opening in the rotatable latching member 40 need not be necessarily hexagonal but may be triangular, rectangular, or square, or may be round with a spline or a small flat section, or may even be round, in which case a set screw or other locking means will be required to make certain that, whenever the bolt 44 is turned, the rotatable latching member 40 positively turns a similar amount without any slack or slippage.

The hexagonal head 46 of the bolt 44 is a standard size but fits relatively closely within the walls of the embossed recess 48 with a relatively small amount of clearance so that a special wrench or tool is required to grip and turn the head 46 of the bolt 44. Thus, a standard size socket wrench or a box-end or open-end wrench or other standard tool cannot fit into the recess 48 and the possibility of tampering and vandalism is lessened. The use of this particular type of hexagonal head 44 and this specific security recess 48 is not necessary and any other tamper-proof head style or security head may be employed. For example, a head having small holes therein suitable for cooperating with the projecting pins of a spanner wrench would also be suitable.

A regular, flat, annular spacer or washer 51 and a spring, flex or disc type washer 53, or other equivalent means, may be used to lessen the wear on the parts involved, to take up any slack, to control and regulate the torque within desired limits, and to provide for a smooth rotational movement of the bolt 44 and the rotatable latching mechanism 40.

It is therefore apparent from FIG. 6 that a person having the required special wrench or tool capable of fitting within the recess 48 and gripping the head 46 of the bolt can rotate the bolt 44 and the rotatable latching member 40 secured thereto. Such a simple and uncomplicated actuating means is all that is required to set in operation the functioning of the unlocking of the self-locking latching mechanism of the present invention.

In FIG. 4, the self-locking latching mechanism and the rotatable latching member 40 are shown in the closed or locked position. In such a position, a lower ear or tab 50 formed from the lower part of the rotatable latching member 40 is immediately adjacent to a lower heel 52 on the side flange 32 of the upper front cover 14. At the same time, an upper ear or tab 54 formed from the upper part of the rotatable latching member 40 is immediately adjacent to an upper heel 56 on the side flange 32 of the upper front cover 14.

The ears or tabs 50, 54 at the opposite ends of the rotatable latching member 40 are formed from the material of the rotatable latching member 40 itself, by having the ends thereof bent downwardly, as viewed in FIG. 4, into a plane substantially at right angles to the plane of the rotatable latching member 40. The length of the bent-down ends should be sufficient to provide enough area to contact the respective heels 52, 56. In most cases, the length of the bent-down ends is in the range of from about 3/16 inch to about 9/16 inch.

The heels 52, 56 are formed in basically the same way from the material of the side flange 32 of the upper front cover 14. The heels, or lanced tabs as such members are often referred to in the industry, are bent upwardly, as viewed in FIG. 4, out of the plane of the side flange 32 and lie in planes substantially at right angles to the plane of the flange 32. The lengths of the bent-up heels 52, 56 are also in the range of from 3/16 inch to about 9/16 inch.

Consideration of the relationships of these ears 50, 54 and the heels 52, 56 reveals that the lower ear 50 prevents the upper front cover 14 from moving downwardly, as viewed in FIG. 4, inas much as any downward force exerted on the lower ear 50 by the lower heel 52 will tend to produce a clockwise rotation of the rotatable latching member 40 about its center 42 which would be prevented by the upper ear 54 butting against the side of the upper front cover 14. At the same time, the opposite or upward movement of the upper front cover 14 is resisted and prevented by the upper heel butting against the flat side of the upper ear 54 in a flat face-to-face contact.

The angular positioning of the face of the upper ear 54 and its spatial relationship to the face of the upper heel 56 must be such that, if the upper heel 56 of the upper front cover 14 is forcibly moved upwardly, it butts against the upper ear 54 in such a direction that, although the upward component or vector of the total force exerted may be relatively large, it is essentially radial in direction with respect to the center 42 and exerts essentially no rotational force on the rotatable latching member 40. Moreover, the tangential component or vector of the total force exerted, although it is at right angles to the radial direction and is therefore basically rotational in character, is relatively very small and is unable to overcome the frictional forces resisting such a rotation.

As a result, the upper ear 54 remains locked in the position shown in FIG. 4 and prevents the upper front cover 14 from moving in an upward direction. In other words, the angular relationships of the faces of the upper ear 54 and the upper heel 56 are such that upward movement of the upper front cover 14 merely locks the upper ear 54 and the upper heel 56 in the closed and locked configuration of FIG. 4.

In addition to these restraints on the movement of the upper front cover 14, a pair of lanced tabs or shoulder rivets or pins 60, 60, somewhat similar in structure and function to the lanced tabs or shoulder rivets or pins 36, 36 previously described, are mounted on the side flanges 20, 22 of the back cover 10 and are adapted to fit and be engaged within guiding or locking slots 62, 62 notched in the side flanges 32, 34 of the upper front cover 14, somewhat similar in structure and in function to the guiding and locking slots 38, 38, previously described. Such an arrangement prevents any outward movement of the upper front cover 14 to the right, as viewed in FIG. 4, as well as preventing any downward movement thereof.

It is thus seen that the upper front cover 14 is securely held in a closed and locked position on the back cover 10 and is prevented from moving in any direction. The interior of the terminal enclosure is well locked and is secure.

THE OPERATION OF THE OPENING MECHANISM

If it is desired to move the upper front cover 14 upwardly and then to the right, as viewed in FIG. 4, in order to open the upper compartment of the terminal enclosure for maintenance, or service, or for any purpose whatsoever, such is easily accomplished by a relatively simple and easy procedure.

A special wrench or tool is fitted within the embossed recess 48 of the side flange 22 of the back cover 10 to grip the head 46 of the bolt 44 and is turned in a counterclockwise direction, as viewed in FIG. 4, to actuate the opening mechanism. At once, several actions are initiated and take place substantially simultaneously to open the terminal enclosure.

First, counterclockwise rotation of the rotatable latching member 40 causes the lower ear 50 to move angularly about the center 42 and to be urged upwardly against the lower heel 52 to apply pressure thereto and forcibly raise the same. As the lower heel 52 moves upwardly, the upper heel 56 also moves upwardly but does not butt into the upper ear 54 which, inasmuch as it is also part of the rotating latching member 40 but located at a greater distance from the center of rotation and therefore moving at a greater linear speed, is moving more quickly out of the way of the upwardly moving upper front cover 14. The rotatable latching member 40 is therefore free to rotate to its full extent and, similarly, so can the upper front cover 14.

Figure 5:
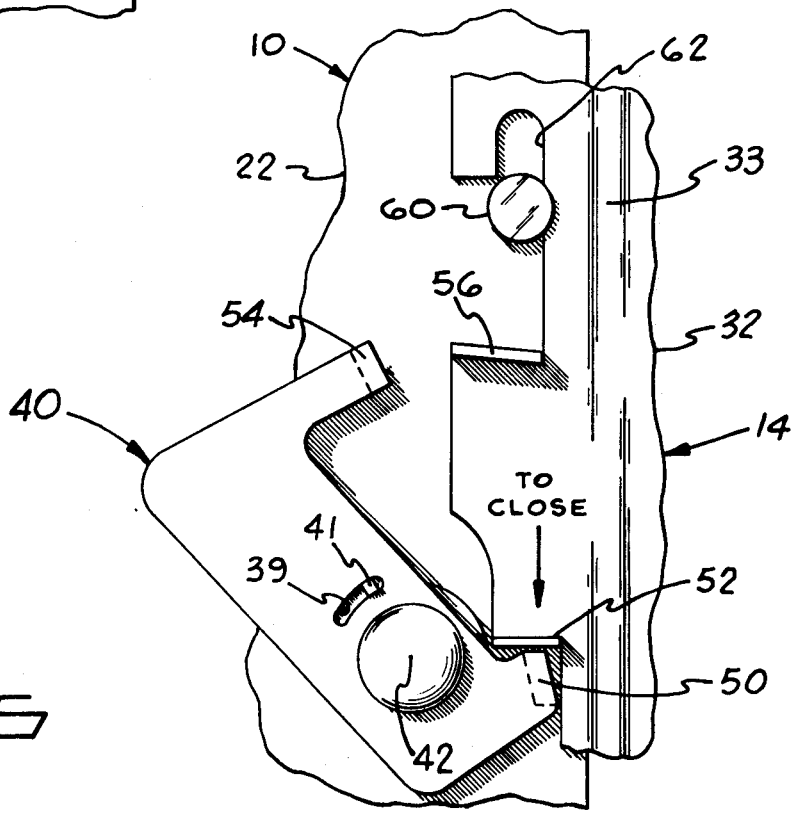
FIG. 5 is a fragmentary, schematic and diagrammatic elevational view of a preferred embodiment of the improved self-locking device and latching mechanism of the present invention in its open or unlocked position, as viewed from the interior of the terminal enclosure.

Also, as this is going on, the locking slots 62, 62 are also moving upwardly and finally reach a point whereat the shoulder rivets, or tabs or pins 60, 60 are no longer engaged by the slots 62, 62 and the upper front cover 14 is able to move to the right, as viewed in FIG. 5.

In this way, the open position shown in FIG. 5 is reached and the upper front cover 14 is free to be removed from the back cover 10 by simply moving it to the right, as viewed in FIG. 5.

It is thus seen that all that is required to unlock and open the terminal enclosure is to insert and turn the special wrench or tool through an angle of from about 20° to about 90°, whereby the upper front cover 14 is instantly freed of all restraints holding it in a closed and locked condition and is capable of being simply and easily removed from the back cover 10 to thus open the terminal enclosure.

THE OPERATION OF THE CLOSING MECHANISM

After the upper front cover 14 has been removed and the necessary work, servicing, maintenance, etc. has been completed, a very simple procedure is instituted in replacing and re-locking the upper front cover 14 to close and lock the terminal enclosure.

The upper front cover 14 is returned to the position shown in FIG. 5 and, if its weight is sufficient, it is simply allowed to drop downwardly under the force of gravity to the closed and locked position of FIG. 4. However, if the weight of the upper front cover 14 is insufficient, or if the particular enclosure is not in a vertical position whereby the force of gravity cannot be utilized, then the upper front cover 14 is given a slight push downwardly to institute the automatic and self-actuating closing and locking operation. As will be seen, this downward movement is all that is required to close and lock the terminal enclosure. No other additional actions need be taken.

First, the lower heel 52 butts against the lower ear 50 and forces it downwardly, thus automatically rotating the rotatable latching member in a clockwise direction about its center 42. The upper ear 54 simultaneously swings around angularly, also in a clockwise direction and moves into a position in back of and on top of the Upper heel 56. And, the guiding and locking slots 62, 62 move down concomitantly so that they move into positions engaging the shoulder rivets 60, 60. Thus, the configuration of FIG. 4 is reached automatically and the terminal enclosure is closed and is locked securely.

It is thus seen that all that is required to close and to lock the terminal enclosure is to place the upper front cover 14 in its correct position and have it move downwardly, whereby the resulting actions of the ears and heels automatically take care of the closing and locking functions in a truly self-actuating and self-locking manner. No insertion or turning of any special wrench is required.

Occasionally, during the work in the interior of the terminal enclosure, a workman may accidentally hit the rotatable latching member 40 which, unless it is restrained, could rotate completely out of the position of FIG. 5 and not be in the correct position to cooperate with the upper front cover 14 when it moves downwardly during the closing operation. As a result, the workman has to first restore the rotatable latching member 40 to the position to FIG. 5 in order that the subsequent locking operation be instituted. This undesirable rotation is avoided by cutting an arcuate slot 39 in the rotatable latching member 40 and forming a projecting tab 41 from the material of the side flange 32 of the back cover 14. When the projecting tab 41 is positioned in the arcuate slot 39, it will permit rotation of the latching member 40 only within limits defined by the ends of the slot 39. As a result, the latching member 40 cannot rotate too far from the desired position of FIG. 5 and will be returned to such a position by the workman automatically when he replaces the upper front cover 14. When he does so, the upper front cover 14 is at its highest position and, as it is placed in position, its upper heel 56 strikes the upper ear 54 and moves it backwardly so that it is in position for the downward movement of the upper front cover 14 as it closes and locks the terminal enclosure.

This invention provides for a simple and easy closing and locking of the terminal enclosure; renders such closing and locking substantially self-actuating and self-locking; permits easy field inspections from a distance to determine if the terminal enclosure is locked, since the mere positioning of the upper front cover 14 in its lower position shows a locked condition; and, further, it virtually eliminates the possibility of a workman forgetting to close and lock the terminal enclosure after completion of work. If desired, special markings may be placed on the terminal enclosures to indicate the upper or unlocked condition and the lower or locked condition.

THE MODIFICATION OF FIG. 7

A modification of the preferred embodiment of the present invention of FIGS. 1–6 is shown in FIG. 7. In some cases, it has been found desirable that, during the opening operation by the special wrench and the bolt 44, the upper front cover 44 be given a small outward movement away from the back cover 10, in addition to the upward movement given to it by the lower ear 50 pushing against the lower heel 52. Such an outward movement creates a small space between the lower edge of the upper front cover 14 and the upper edge of the lower front cover 12; enables a workman opening the terminal enclosure to more safely grasp the lower end of the upper front cover and remove it without fear of pinching his fingers.

This is achieved by the embodiment of FIG. 7 wherein there is shown basically the same device of FIGS. 1–6 with one important change. In FIG. 7, there is shown the back cover 10, the rotatable latching member 40 capable of rotating about the center of rotation 42, and the lower ear 50, capable of forcing the lower heel 52 upwardly. However, there is a modified upper front cover cover 14' capable of creating the desired extra, outward movement.

The primary difference is the existence of a sloping or slanting cam surface 70 on a part of the upper front cover 14', or more specifically its side flange 32'. It is to be appreciated that, as the lower ear 50 rotates around angularly in its counterclockwise opening movement to move the upper front cover upwardly, at a later time during such angular rotational movement, the trailing end of the ear 50 butts against the slanting or sloping cam surface 70 and forces it outwardly a short distance from the back cover 10 of from about ¼ inch to about ¾ inch. Such distance may be varied, however, as desired or required, by varying the height of the cam surface 70. This is a particularly advantageous feature of this modification whenever the upper front cover 14 or whatever cover or member is being removed when such cover or member is heavy and the possibility of pinched or even crushed fingers is possible.

The present inventive concept will be described in greater detail by reference to the following specific Examples wherein there are illustrated preferred embodiments of the present inventive concept. However, it is to be appreciated that such Examples are given primarily for illustrative purposes and are not to be construed as limitative of the broader aspects of the invention.

EXAMPLE I

The self-locking latching mechanism illustrated in FIG. 1–6 of the drawings is used for this Example. The back cover is about 48 inches long and has a rear wall of about 6 inches and side flanges of about 3½ inches each (all outside dimensions). The lower front cover is about 24 inches long and has a front wall of about 6 inches and side flanges of about 3½ inches each (all outside dimensions).

The lower front cover is secured to the back cover, with their lower ends about even, and they are buried to a depth of about 19 inches, leaving about 29 inches of the back cover above ground and about 5 inches of the lower front cover above ground.

The upper front cover is about 24 inches long and has a front wall of about 6 inches and side flanges of about 3½ inches each (all outside dimensions). There are slight off-set portions of both the lower front cover and the upper front cover so that they can nest within the side flanges of the back cover. The upper front cover is made of 14 gage steel, is galvanized, and has a weight of about 6 pounds.

The cap has a horizontal-plane cross-section of about 6 inches by 6 inches square and has a depth of about 2 inches (all inside dimensions). The cap fits over the top portions of the back cover and the upper front cover, when they are assembled in use. The cap is secured to the back cover by riveting to prevent it from being lost or misplaced in service.

The ears on the rotatable latching member are bent downwardly, as viewed in FIG. 4, by a length of about ⅜ of an inch and the heels on the side flange of the upper front cover are bent upwardly by a length of about ⅜ of an inch. A rotation of the rotatable latching member of only 33° is found sufficient to provide the necessary upward movement of the upper front cover.

Locking slots and guiding and locking shoulder rivets are used on the side flanges of the upper front cover and the back cover, respectively.

The unlocking and opening of the terminal enclosure is carried out very simply by merely inserting and turning the special wrench so that the actuating bolt and the self-locking latching member rotate about 33° in a counterclockwise direction. During this rotation, the lower ear on the self-locking latching member contacts a lower heel on the upper front cover and forcibly moves it upwardly, while the second ear on the self-locking latching member is being simultaneously moved out of the way of the upwardly moving upper front cover. The upper front cover is released from its restraints and is then easily manually lifted out of place and removed to open the terminal enclosure.

After the necessary work in the interior of the terminal enclosure is completed, the upper front cover is manually replaced in position and is given a slight push in the downward direction, whereby the lower heel automatically contacts the lower ear to forcibly rotate the self-locking latching member in a clockwise direction, whereby the upper front cover returns to its original locked position with respect to the back cover, being automatically locked therein by the first ear and the second ear.

It is to be observed that, once the upper front cover is placed in its upper position, as shown in FIG. 5, and then given a slight push downwardly, that all subsequent action is self-actuating and spontaneous, leading to a self-locking of the terminal enclosure. The use of a special wrench or tool is not required during such closing and self-locking operations, thereby sustantially eliminating the possibility of a workman or service man forgetting to lock the terminal enclosure, or being incapable of locking the same, because he may have lost or mislaid the special wrench or tool while he was working on the terminal enclosure.

EXAMPLE II

The procedures set forth in Example I are followed substantially as described therein, with the exception that the modified side flange of the upper front cover is used. This modified side flange has the slanting or sloping cam surface shown in FIG. 7. The unlocking and opening operations and the closing and locking operations are generally similar to those set forth in Example I, except that, during the latter part of the upward movement of the upper front cover, it is simultaneously moved outwardly from the back cover by a distance of about ½ inch, as measured in the area where the upper front cover is immediately adjacent to the lower front cover. This space facilitates the gripping of the upper front cover and the opening of the terminal enclosure and lessens the possibility of pinched or crushed fingers.

In both Examples I and II, the usefulness of the arcuate slot and the projecting lanced tab which slidably fits therein is to be noted. Even when the rotatable latching member is inadvertently moved from the open position shown in FIGS. 5 and 7, to the closed position of FIG. 4, it will be automatically returned to the proper open position when the upper front cover is replaced and its upper heel 56 or the adjacent protruding portion strikes the upper ear 54 of the rotatable latching member 40 to move it to the proper open position. As a result, it is seen that the replacement of the upper front cover 14 is all that is required, regardless of the position of the rotatable latching member 40.

Also, in both Examples I and II, it is to be noted that the upper face of the upper ear is substantially parallel to the side face of the upper heel and that part of the rotatable latching member immediately adjacent thereto (see FIG. 4) so that any contact between them is flat and substantially across their entire faces. Additionally, it is to be noted that the upper face of the upper ear and the side face of the upper heel and that part of the rotatable latching member are within a few degrees, that is, less than about 10°, and actually only about 6° in the cases of Examples I and II of being at right angles, or in the tangential direction, with respect to the center of rotation of the rotatable latching member. Reference is made specifically to FIG. 4 and it is to stated that the 6° angle therin between the upper face of the upper ear and the tangential direction should be in the range of from about 0° to about 10°.

In FIG. 4 of the drawings, this angle is identified as angle "A" and is exaggerated in FIG. 4 in that it is illustrated as being about 16°. This has been done solely to emphasize the nature and the direction of such an angle between the face of the upper ear 54 and the tangential direction, with respect to the center of rotation of the rotatable self-locking latching member 40.

As a result of such spatial relationships, if the upper ear were to be urged upwardly in an effort to forcibly open the terminal enclosure, such as viewed in FIG. 4, the upper face of the upper ear would strike the side face of the upper heel and the adjacent portion of the rotatable latching member in a very flat, full manner and would create forces which extend almost entirely in the radial direction and almost negligibly in the tangential direction, whereby there would be essentially no effective force exerted to rotate the rotatable latching member in the counterclockwise direction. Any force exerted in the tangential direction would be insufficient to overcome the frictional forces which would be present and the rotatable latching member simply would not rotate to open the terminal enclosure. A locked condition would exist.

Although only a few specific Examples of the present invention have been described, it is to be recognized that the broader aspects of the present invention are not to be construed as limited to the specific materials and constructions disclosed therein, but to include various other materials and constructions, as well as various other equivalent features, as set forth and included in the spirit and the scope of the claims appended hereto.

What is claimed is:

1. A self-locking device for locking a first enclosure member to a second enclosure member, or for unlocking the same, comprising:

a first enclosure member; a second enclosure member; a self-locking latching member rotatably mounted on said first enclosure member; and a ratatable actuating means rotatably mounted on said first enclosure member for rotating said self-locking latching member;

said self-locking latching member having a first ear thereon, capable of preventing said second enclosure member from movement in a first or opening direction, and a second ear thereon capable of preventing said second enclosure member from movement in an opposite direction, whereby said second enclosure member is locked with respect to said first enclosure member;

said second enclosure member having a first heel thereon adjacent to and facing said first ear on said self-locking latching member and a second heel thereon adjacent to and facing said second ear on said self-locking latching member;

a face on said first heel of said second structural member; and a face on said first ear of said rotatable self-locking latching member, said face on said first heel being so angularly positioned and in such spatial relationship with respect to said face on said first ear and with respect to the center of rotation of said rotatable self-locking latching member during the closed position of said enclosure members that forcible movement of said face on said first heel against said face on said first ear in said first or opening direction causes said first heel to move and to abut against the face on said first ear with a relatively large force on said rotatable self-locking latching member but which force is essentially radial in direction with respect to the center of rotation of said rotatable self-locking latching member and thus creates essentially no rotational force on said rotatable self-locking latching member, whereby movement of said second enclosure member in said first or opening direction is prevented and the closed position of said enclosure members is maintained;

said rotatable actuating means being capable of rotating said self-locking latching member, whereby said second ear on said self-locking latching member contacts said second heel on said second enclosure member and forcibly moves it in said first or opening direction, while said first ear on said self-locking latching member is being simultaneously rotated out of the way of said first heel on said second enclosure member to permit movement of said second enclosure member in said first or opening direction to open and to unlock said second enclosure member from said first enclosure member;

and said second heel on said second enclosure member being subsequently capable of being moved in said opposite direction to contact said second ear on said self-locking latching member to forcibly rotate said self-locking latching member in a direction opposite to that of the first rotation, whereby said second enclosure member returns to its original closed and locked position with respect to said first enclosure member, being automatically locked therein by said first ear and said second ear of said self-locking latching member.

2. A self-locking device as defined in claim 1, wherein said first enclosure member is stationary and said second enclosure member is movable.

3. A self-locking device as defined in claim 1, wherein said first enclosure member is the back cover of a terminal enclosure and said second enclosure member is the removable upper front cover of said terminal enclosure.

4. A self-locking device as defined in claim 1, wherein additional locking means are provided on said first enclosure member to prevent movement of said second enclosure member when in a closed and locked condition in a direction generally at right angles to said first or opening direction and said opposite direction.

5. A self-locking device as deined in claim 1, wherein said rotatable self-locking latching member is capable of being rotated within the range of from about 20° to about 90°.

6. A self-locking device as defined in claim 1, wherein said first ear and said second ear are located on opposite ends of said rotatable self-locking latching member.

7. A self-locking device as defined in claim 1, wherein means are provided on said second enclosure member to bring about an additional movement of said second enclosure member in a direction generally at right angles to said first or opening direction at the same time that said second enclosure member is moving in said first or opening direction.

8. A self-locking device as defined in claim 7, wherein said means on said second enclosure member for providing movement of said second enclosure member in said right angle direction is a cam surface on said second enclosure member.

9. A self-locking device as defined in claim 3, wherein said terminal enclosure is positioned vertically and said first or opening direction is upward and said opposite direction is downward.

10. A self-locking device as defined in claim 1, wherein said actuating means rotatably mounted on said first enclosure member rotates said rotatable self-locking latching member within limits fixed by stops.

11. A self-locking device as defined in claim 6, wherein said second ear is located at a greater distance from the center of rotation of said self-locking latching member than said first ear.

12. A self-locking device as defined in claim 1, wherein said rotatable self-locking latching member is rotatable about a pivot point located between said first ear and said second ear, whereby rotation of said self-locking latching member causes said first ear to move in a direction opposite to that of said second ear so that, during the first or opening movement, said first ear moves away from said second enclosure member whereas said second ear moves toward said second enclosure member.

13. A self-locking device as defined in claim 1, wherein said rotatable actuating means and said rotatable self-locking latching member rotate about the same pivot point as an axis of rotation.

14. A self-locking device as defined in claim 1, wherein said rotatable actuating means comprises a rotatable shaft which passes through a closely fitting, matching opening in said rotatable self-locking latching member, whereby rotation of said rotatable actuating means creates a similar rotation of said rotatable self-locking latching member.

15. A self-locking device as defined in claim 1, wherein said force is within from about 0° to about 10° of the radial direction.

* * * * *